United States Patent [19]

Manini

[11] Patent Number: 4,739,636

[45] Date of Patent: Apr. 26, 1988

[54] CIRCULAR KNITTING MACHINE

[75] Inventor: Benito Manini, Florence, Italy

[73] Assignee: Cesare Colosio S.r.l., Italy

[21] Appl. No.: 744,112

[22] Filed: Jun. 12, 1985

[51] Int. Cl.[4] ..... D04B 15/78

[52] U.S. Cl. ..... 66/220; 66/115

[58] Field of Search ..... 66/75.2, 115, 219, 220

[56] References Cited

U.S. PATENT DOCUMENTS

| | | | |
|---|---|---|---|
| 3,605,448 | 9/1971 | Ribler | 66/75.2 X |
| 3,665,731 | 5/1972 | Groezinger | 66/219 |
| 3,710,594 | 1/1973 | Bourgeois | 66/220 |
| 3,861,173 | 1/1975 | Kinkelin | 66/220 |
| 3,863,465 | 2/1975 | De Gerjat et al. | 66/219 |
| 3,972,206 | 8/1976 | Mureso | 66/220 X |
| 3,987,646 | 10/1976 | Knourek et al. | 66/220 X |
| 4,020,652 | 5/1977 | Savage | 66/220 |

FOREIGN PATENT DOCUMENTS

| | | | |
|---|---|---|---|
| 1171105 | 5/1964 | Fed. Rep. of Germany | 66/115 |
| 819686 | 9/1959 | United Kingdom | 66/115 |

*Primary Examiner*—Wm. Carter Reynolds

*Attorney, Agent, or Firm*—McGlew and Tuttle

[57] ABSTRACT

A circular knitting machine for hosiery includes an electromagnetic needle selection system. This selection system includes pivotal selector devices which act on resilient pushers and which are pushed indiscriminately or selectively against the resilient action of the pushers by radially acting cams. The system also includes groups of electromagnets which are placed annularly around the cylinder to exert a retaining effect on the selected cams when they are pushed against these by radially acting cams. In addition, electromagnets are placed between adjacent retaining electromagnets and they are of a size not exceeding the gap between the needles and the adjacent jacks. The jacks are excited selectively by means of a program control in order to exert the same retaining action as the retaining electromagnets and to effect abandonment or relinquishing of a selector which is moving.

9 Claims, 3 Drawing Sheets

CIRCULAR KNITTING MACHINE

The present invention relates to a circular knitting machine with electromagnetic needle selection systems.

In circular or straight knitting machines, needle selection systems are known utilizing electromagnets and permanent magnets which attract or repel intermediate members in accordance with a predetermined programme under electronic control placing them alternately in an active or inactive position, so that only two types of control are possible, are known.

In order to obtain needle selection with these machines it is necessary to use magnets of small dimensions with regard to their width (for example and in particular less than one pitch less the thickness of the needle) in order to avoid influencing an adjacent needle, and therefore the forces available and the displacements which can be achieved are fairly limited and unreliable. These selector members, which must generally oscillate and run vertically within the grooves in the cylinder when pushed by the selector cams, are normally of hardened steel and are therefore capable of being magnetised by induction.

The strength of permanent magnets tends to be reduced or even lost when they are influenced by electromagnets of opposing polarity; in any event, and especially in a closed machine, they tend to set up undesirable permanent magnetic fields.

Residual magnetism, magnetic hysteresis and magnetisation of the steel members, including the cylinder, contribute to rendering the movement of the selector unreliable and limit the amount of information which can be transferred per unit time. In point of fact the speed of the machine and its fineness or gauge are limited, or magnets of great strength and therefore great size are unavoidable.

When instructions or information of three kinds is to be transferred—needle in the low position, needle in the retained stitch position and needle in the emergent position—at least two separate sets of cams and groups of selector electromagnets are required.

In large diameter circular knitting machines or straight knitting machines where the space between one yarn feed and the next may, when necessary, be increased by as much as is required and speeds are never excessive, such arrangements may be accepted without major problems of space. In the case of circular knitting machines for hosiery, which are much more complex and faster than straight or circular knitting machines and have very little available space because of the restricted diameter of the needle cylinder, the situation is very different. In particular in the case of a knitting machine for knitting a patterned sock, it is necessary to provide four stations around a cylinder having a diameter of 3¾" of 4" (96 mm or 103 mm), each or which is capable of working symmetrically in both directions of movement of the cylinder and with the need to select needles at three different heights in order to obtain: a low position, lifting with the stitch retained and lifting with the stitch projected or released.

It is an object of the invention to provide means enabling selection of the needles of a circular hosiery knitting machine which is particularly but not exclusively suitable for manufacturing patterned socks or jacquard in general and retained stitch using limited space both as regards height and angular width and having small magnetic forces while ensuring high response speeds and operating reliability in the two directions of movement and at three different heights.

The invention therefore relates to a needle selection system of the electromagnetic type in a circular hosiery knitting machine or the like comprising a needle cylinder with channels for needles, jacks or underneedles and resilient pushers and also comprising a skirt of cams with control cams for selectively lifting the resilient pushers and therefore the needles to one or even two levels (retained stitch and projecting or dropped stitch), lowering cams and selector devices combined with each feed.

In accordance with the invention the selector devices, of the elecromagnetic or mechanical type, comprise: rocking or pivotable selectors which act on the resilient pushers and which are pushed indiscriminately or unselectively against the resilient action of the said pushers by radially acting cams; groups of electromagnets angularly disposed around the cylinder to exert a retaining action on the oscillating selectors when pressed against them by the radially acting cams and against the resilient stress; and selector electromagnets located between adjacent retaining electromagnets of a size not greater than the gap between adjacent needles and jacks which can be excited selectively in accordance with a programme in order to exert the same retaining action as the retaining electromagnets and respectively to abandon or relinquish a selector in transit which then permits elastic relaxation of the corresponding elastic selector thus bringing about selection.

The selector electromagnets are energised or excited by a high current to exert the retaining action and by a weaker current in the opposite direction to cancel the residual magnetism in the selector which is to be abandoned.

Adjacent electromagnets, or adjacent sets of electromagnets may be excited so as to have reversed polarities, to avoid or reduce the residual magnetism in the ferromagnetic parts of the machine which may be affected by the magnetic fluxes.

The rocking selectors may be of the substantially straight rocker type.

In order to activate selection and discrimination in the lifting of the needles the selector electromagnets are placed at the start of the corresponding lifting ramps.

Cams with two lifting ramps for two different lifting movements ( released stitch and retained stitch) and two corresponding selector electromagnets to select lifting of the needles may be provided corresponding to each feed.

On a machine in which needles operate in an alternating manner, the groups of selector and retention electromagnets are substantially symmetrical and are placed between two adjacent feeds and pairs of selective lifting ramps are also symmetrical, but with respect to each feed.

In order to avoid magnetisation phenomena the needle cylinder may have at least one section of non-ferromagnetic material in a position substantially corresponding to the electromagnets and the rocking selectors.

The invention will be described further, by way of example, with reference to the accompanying drawings in which there is illustrated a non-restrictive example of an embodiment of the invention, and in which.

Figure 1:
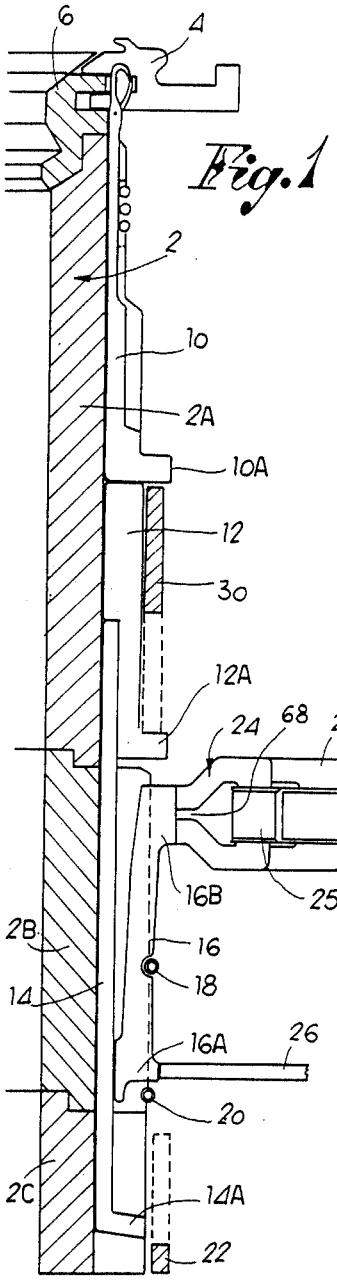
FIG. 1 is a partial diametral cross-section of a needle cylinder with some associated members.

With reference in the main to FIG. 1, which illustrates, in cross-section, one set of primary members of a circular knitting machine for knitting hosiery operating according to the invention wherein there is provided a needle cylinder 2 with longitudinal channel and appears to be constructed of several parts 2A, 2B, 2C for the purposes described below, sinkers 4 are provided which cooperatively act together with inside sinker ring 6 of the sinkers or plates. In the drawings, generally only a single one of each of a plurality of the components are illustrated. Traditional latch needles 10 are provided having butts 10A and act in association with "jacks" 12 which in turn act in association with spring or resilient pushers 14 having lower butts 14A and associated with corresponding oscillating pivoting or rocking selectors 16. The selectors 16 are held by a fulcrum spring 18 which determines their point of oscillation and by a counterspring 20 which limits the oscillation in one direction.

A cam 22D is used to raise spring or resilient pusher 14 acting against butt 14A when the pusher is not deformed or flexed inwards. Direct current selector electromagnets 24 are provided with corresponding excitation coils 25. Postioning cams 26 for selectors 16 act against the lower ends 16A of the oscillating selectors while ends 16B act together with electromagnets 24 and retaining electromagents 28, these too having direct current windings.

Figure 2:
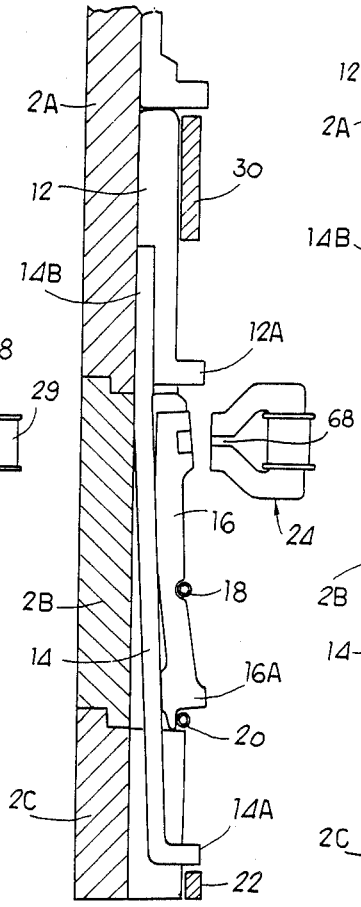
FIGS. 2 and 3 are views similar to FIG. 1, but only showing some of the members therein, in different arrangements.
Figure 3:
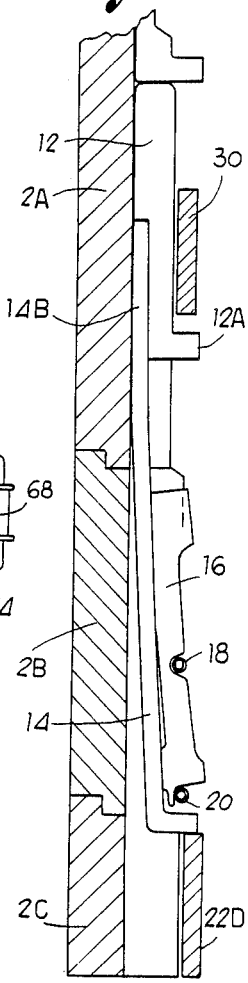

FIGS. 2 and 3 show the fundamental members of those described above in arrangements reached during stages in operation.

Figure 4:
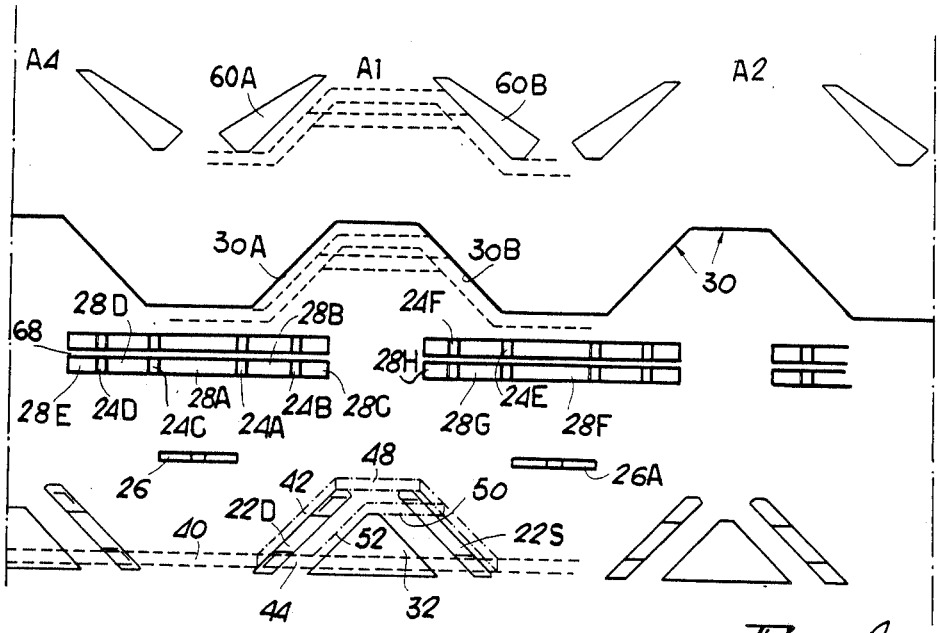
FIG. 4 and 5 are schematic illustrations of part of the cam skirt and a diagram of the cams therein in plan.
Figure 5:
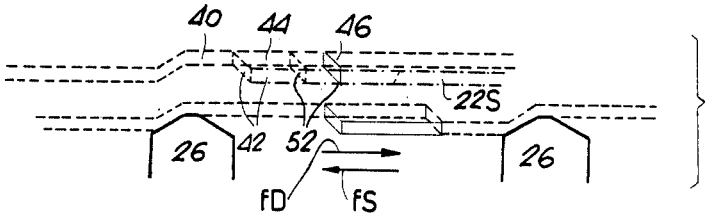
Figure 6:
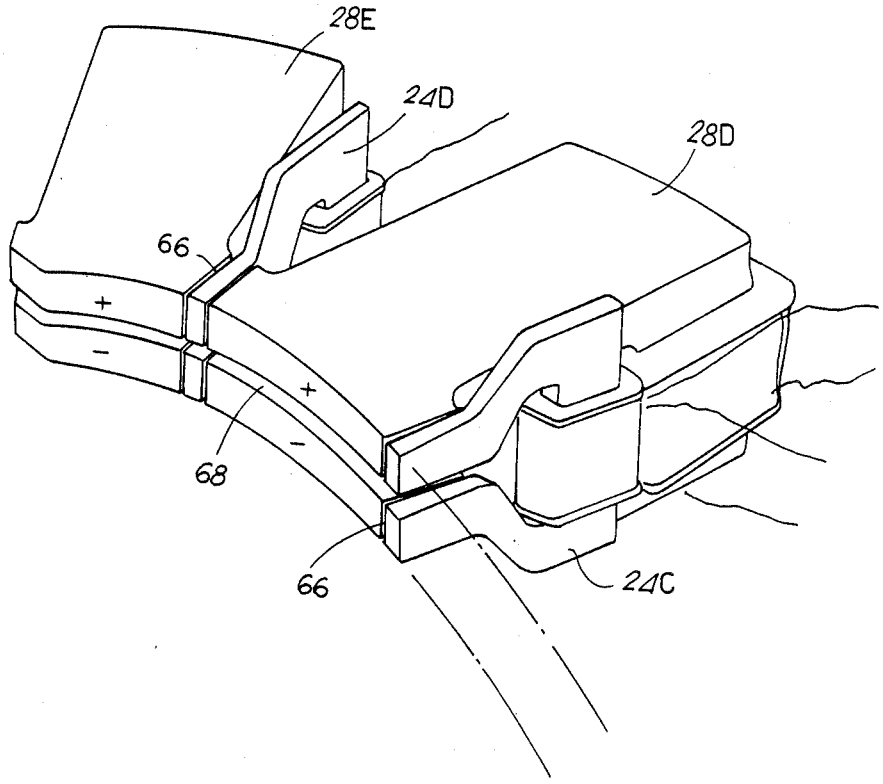
FIG. 6 is a perspective view of magnetic activating members.

FIG. 4 shows part of the cam skirt with cams 22D and 22S and 32 which select and lift the pushers, groups of selector electromagnets 24 and retaining electromagnets 28 grouped in the manner described below, cams 30 for lowering jacks 12, stitch drawing cams 60 (acting on butts 10A of the needles), and positioning cams 26 which act radially on the ends 16A of rocking selectors 16. In FIG. 5 cams 26 and 30 are shown turned over in plan and the various movements 38-40-42-44-46 and 48 of the feet of the pushers in the various stages which will be described below are shown diagrammatically. FIG. 6 shows retaining electromagnets 28 and selector electromagnets 24 in a perspective view. It will be seen that electromagnets 28 extend between selector electromagnets 24 and that the widened poles of all the electromagnets are arranged on two superimposed lines and are spaced to a limited extent. Needle cylinder 2 is advantageously constructed of three parts 2A, 2B, 2C of which the central part is constructed of bronze or other non-magnetic metal so as to prevent the formation of undesirable magnetic fields. Within each vertical groove in the cylinder is mounted jack 12, in addition to jack 12, which is held against the cylinder by ring of cams 30 (FIG. 1) which also activates the jack lowering cam and pusher 14. The upper portion 14B of resilient pusher 14 (see FIG. 2) is bent through a certain angle and therefore once this portion 14B has slipped beneath the body of jack 12 the lower part of pusher 14 tends to remain resiliently away from the base of the cylinder groove and butt 14A tends to be in the path of lifting cam 22. The maximum outward position of resilient pusher 14 is limited by pivoting or rocking selector 16 which also slips into the same groove in the cylinder and is held in position by circular fulcrum spring 18 which is ring mounted around the cylinder in a suitable groove and by circular counterspring 20 which is also ring mounted around the cylinder in another suitable groove and which limits the outward movement of the lower part of selector 16. When butt 14A of pusher 14 is in the projecting position, this butt projects from the cylinder and may be engaged by the profile of lifting cam 22 in order to be raised. When rocking selector is pressed at point 16A by cam 26 (see FIG. 1) pusher 14 is squeezed resiliently into the groove and butt 14A disappears into the cylinder groove itself; in this way the pusher is not lifted by rising cam 22. Leaving rocking selector 16 free, resilient pusher 14 resumes the position in FIG. 2 and may be lifted by cam 22 with ramp 22D or 22S (FIGS. 3 and 5) or by cam 32 (FIG. 5).

Corresponding to each symmetrical feed unit, of which feed unit A1 and part of feed unit A2 is shown in FIG. 4, there are two stitch drawing cams such as 60A and 60B which lower the needles in two directions, two profiles 30A and 30B of cams 30 which lower the jacks 12 and a set of cams with symmetrical selector cams 22D and 22S which can raise pushers 14 to the height of the projecting needles and with a symmetrical cam 32 which can raise pushers 14 to the height of the retained needle in both the directions of movement indicated by arrows fD and fS. A cam 26 and a group of direct current electromagnets 24 and 28 are provided between one feed unit and the next (see FIG. 6).

Retaining magnet 28 is of a kind with widened poles and means are provided by which it is subjected to a direct current which is always in the same direction so that the magnetic force always has the same polarity, for example as shown in FIG. 6. Selector magnet 24 however is of a kind which is sufficiently narrow to act on only one rocking selector 16 at a time without affecting those adjacent to it and may be subjected to direct current in both directions but of a different strength: a maximum when the polarity accords with that of magnets 28 and a minimum when it does not, for reasons which will be explained below.

The two kinds of electromagnet are mounted alongside each other separated by thin layers 66 of non-magnetic metal in the sequence indicated in FIG. 5 so as to form a sector of an arc concentric with the needle cylinder. FIG. 5 shows one arrangement in which the group of magnets includes a central magnet 28A, two magnets 24A, 24C flanking it and still in sequence two magnets 28B, 28D, two magnets 24B, 24D and two external magnets 28C, 28D with a bevelled groove. Magnets 28F, 28G and 28H corresponding to 28A, 28D, 28E are indicated in the adjacent group. It will be noted that the selector electromagnets like electromagnets 24A and 24B are located immediately above the start of the lifting ramp of cams such as 22D and 32; this happens for each group and for each direction of rotation of the cylinder. There are as many groups of magnets as there are feeds and groups of cams 60, 22S, 22D, 32, but each group of magnets is able to work symmetrically for the two adjacent feeds in both directions of movement. This arrangement takes account of the case in which two lifting heights and one lowering height, and therefore three selection heights in all, are required. It is obvious that if there were only two selection heights instead of three the group of magnets for selecting the needles would be reduced to only 28A, 24A and 28B and the symmetrical magnets and the necessary lifting cams would only be 22S and 22D for each feed.

The manner of operation is more fully described in the following description.

The selection stages during the working with alternating movement required for the construction of a pattern is considered and it is assumed that no needle must be lifted to take the yarn in feed A1 during the first oscillation of the cylinder. Electromagnets 28A, 24A, 28B, 24B, and 28C will be subjected to the passage of current so that they have the same polarity, for example positive at the top and negative at the bottom, as shown in FIG. 6. In passing in front of fixed cam 26 rocking selectors 16 are pressed against foot 16A and pivoted about fulcrum 18 so as to bring upper part 16B in abutting arc grazing contact with the widened poles of retaining electromagnet 28A and at the same time to squeese pusher 14 with respect to each of the said selectors 16. The magnetic force is designed so as to be markedly greater than the resilient reaction of pusher 14 and therefore selector 16 remains attracted by the magnetic effect and keeps pusher 14 under pressure even when the action of cam 26 ceases. If electromagnets 24A and 24B are magnetised in the same direction at the same time pusher 16 will travel along the path shown by 40, 44 and 46 in FIG. 5, passing behind lifting cams 22 and 32 and thus no needle will be lifted. As soon as butt 14A passes inside cam 32 (without being raised) the magnetic effect is no longer necessary and the sector of electromagnets 24–28 may be switched off. Cams 22S and 22D are bevelled internally to allow the passage of butts 14A.

As the arrangement of the electromagnets and all the cams is perfectly symmetrical the manner of operation is also the same when the cylinder moves in direction fS (in the opposite direction to that first considered), it being, however, borne in mind that cam 26A and retaining magnets 28F, 28G, and 28H may be provided to select the needles required for fS while the selection is made by selector magnets 24E and 24F.

If all the magnets remain excited in the same way no needle will be lifted for feed A1.

Now it is assumed that it is desired to select the needles so that, for example, the needle in a first position is raised to the projection level and the needle in a second position which is spaced away from the first position by another needle and is raised to the lower level of the retained stitch.

Through the action of cam 26, all the selectors 16, moving in direction fD, are now forced to enter into contact with central electromagnet 28A and remain attracted by it. When the needle in position I passes in front of the wider polar portions of electromagnet 24A the electronic control (which is synchronised in a known manner) interrupts the normal passage of current to electromagnet 24A and instantaneously reverses the current, but at a lower strength designed to cancel out the residual magnetism of selector 16 to assist its immediate separation from the wider polar portions through the resilient effect of pusher 14, but hardly has this happened when the polarity of the new magnetism induced in that pivoting selector is reversed. This brings about the immediate return of selector 16 to the normal condition in FIG. 2 and butt 14A of pusher 14 follows the track indicated by 40, 42, 48, as shown in FIG. 5, and will be engaged by cam 22D (FIGS. 2, 3 and 4) and will be raised to the projection height (zone 48 in FIG. 4). As soon as the selector corresponding to the needle in position I leaves the field of action of electromagnet 24A, the normal current is restored and as a result the selectors corresponding to the subsequent needles and selectors in positions II and III etc., remain in contact with the expanded polar portions of electromagnets 24 and 28A by magnetic attraction, and the corresponding butt 14A of pusher 14 will travel along path 40, 44, 46 passing behind cam 22A. Electromagnet 24B will remain excited in turn while the selector moves to position II and remaining attracted will cause the pusher to follow the path 44, 46 and will then also pass behind cam 32 and therefore will not be raised. When on the other hand selector 14 passes in front of electromagnet 24B in position III said electromagnetic 24B will reverse polarity as described above. Selector 16 in position III then returns to the rest position as it is no longer attracted and corresponding pusher 14 (FIG. 1) travels along the path 40, 44, 52, FIG. 5) and is engaged by cam 32 which will lift it to the level of retained stitch 50 along path 40, 44, 52, 50 in FIG. 4. By means of butt 12A profile 30B lowers each jack 12 and corresponding pusher 14 (which are raised) after selection while the selected needles 10 draw a stitch by means of cam 60B in their corresponding raised positions.

The normal components commonly used in hosiery machines have been omitted from the drawing for greater simplicity and clarity.

Adjacent electromagnets 28, or adjacent groups of electromagnets 28E, 28D, 28A, 28B and 28C may be excited with reversed polarities. Residual magnetism in the ferromagnetic parts of the machine is cancelled and prevented from building up by this means.

In order to construct groups of electromagnets 24A, 24B, 24C, 24D and 28A, 28B, 28C, 28D, 28E members 68 may be placed at least between the widened poles and form spacers 66 using self-lubricating resins or plastics materials (such as nylon) so that the active surfaces of the said widened poles barely project and after a limited amount of wear of the ends 16B become flush with self-lubricating resin or plastics surface 68 upon which the said ends 16B continue to slide with very much reduced wear.

It is worth while pointing out that the ferromagnetic alloys having the mechanical properties of very great hardness which are now available may be used for the magnetic cores without it being necessary to use permanent magnets. Wear is therefore virtually negligible regardless of the abovementioned provision of self-lubricating synthetic resins or plastics.

The device in question has obvious advantages and required features including:

(1) Minimum power requirements in operation because the magnets act by contact and are therefore in a position to exert maximum force.

(2) The parts which are to be attracted are brought mechanically close by means of cams 26 and rocking selectors 16.

(3) Speed of response obtained by reversing the polarity and lowering the voltage.

(4) The elimination of permanent magnetic fields and residual magnetism as a result of cyclic reversal of the polarity and the use of a cylinder which is partly non-magnetic (8B).

(5) When the machine is stopped and there is no magnetisation the magnets are not energized.

It will be understood that the drawing only shows an embodiment provided by way of a practical demonstration of the invention which may be varied in form and arrangement without going beyond the scope of the concept characteristic of the invention itself. The object of any reference numbers in the appended claims is to aid understanding of the claims with reference to the description and the drawing and they are not intended to restrict the scope of the protection given by the claims.

I claim:

1. A circular knitting machine, comprising a needle cylinder for rotation in opposite directions and having a plurality of axial grooves therein, a needle mounted in each groove for movement axially of the cylinder, a jack in each groove engageable with the needle and moveable axially of the cylinder, a resilient pusher in each groove, each pusher being engaged with a jack, each pusher having an end which is resiliently moveable away from the cylinder, cam means with control cams for selectively raising the resilient pushers when their resilient ends are away from the cylinder, and thus for raising an engaged jack and needle of the resilient pusher to two levels for retained and released stitches of the needle, said cam means including lowering cam for lowering the resilient pushers, a plurality of feeds around said cylinder for cooperating with said needles to form stitches, and oscillating selectors mounted in each groove and having a portion engageable with a pusher in each groove for moving the end of the pusher out of a path of the control cams, said cam means including radially acting cams for unselectively engaging said oscillating selectors with rotation of the cylinder to unselectively move the ends of the pushers against the cylinder in away from the path of the control cams, a plurality of groups of retaining electromagnets which are disposed around said cylinder and are operable to exert a retaining action on the oscillating selectors when the oscillating selectors are pressed against the electromagnets by the radially acting cams, and a plurality of selector electromagnets each located between an adjacent pair of retaining electromagnets and having a width in the rotational direction of the cylinder which does not exceed a gap between the grooves of the cylinder which contain the needles, the jacks, the pushers and the selectors, and program means for selectively activating said selector electromagnets to individually release an oscillating selector from the magnetic hold of an adjacent retaining electromagnet as the cylinder rotates in either said direction to permit resilient relaxation of the corresponding resilient pusher and thus effect a selection of that pusher.

2. A machine as claimed in claim 1 in which said selector electromagnets are excited by a high current to exercise the retaining action and by a weaker current in the opposing direction to cancel the residual magnetism in the selector which is to be released.

3. A machine as claimed in claim 1 or 2, in which the means are provided so that the electromagnets are operable to have a reversed polarity to prevent the formation and build-up of residual magnetism.

4. A machine as claimed in claim 12, in which each of the oscillating selectors is constructed with a substantially straight rocker.

5. A machine as claimed in any of claims 1 or 2, in which the said selector electromagnets are placed at the start of the corresponding control cams.

6. A machine as claimed in any of claims 1 or 2, in which said control cams include two lifting ramps for two different lifting movements and two corresponding selector electromagnets to select lifting of the needles are provided for each feed for lifting.

7. A machine as claimed in any of claims 1 or 2, operable with alternating movements of the needles, characterised in that the groups of selector and retaining electromagnets are substantially symmetrical and are located between two adjacent feeds and that pairs of selective lifting ramps are also symmetrical, but with respect to each feed.

8. A machine as claimed in any of claims 1 or 2, in which the needle cylinder has a section of non-ferromagnetic material which is substantially on the same level as the electromagnets and the oscillating selectors.

9. A machine as claimed in any of claims 1 or 2, in which said electromagnets have expanded poles aligned at two axially spaced circumferences of said cylinder, and in which between them there lies a surface of non-ferromagnetic material which is wear resistant and self-lubricating on which the parts of the oscillating selectors which are subjected to the action of the electromagnets can slide.

* * * * *